US005719775A

United States Patent [19]

Abumehdi

[11] Patent Number: 5,719,775

[45] Date of Patent: Feb. 17, 1998

[54] FRANKING MACHINE AND FRANKING MACHINE SYSTEM

[75] Inventor: Cyrus Abumehdi, Harlow, United Kingdom

[73] Assignee: Neopost Limited, Essex, United Kingdom

[21] Appl. No.: 575,323

[22] Filed: Dec. 20, 1995

[30] Foreign Application Priority Data

Dec. 22, 1994 [GB] United Kingdom ..... 9425953

[51] Int. Cl.[6] ..... G07B 17/04

[52] U.S. Cl. ..... 364/464.2; 340/825.32

[58] Field of Search ..... 340/569, 570, 340/825.32; 364/464.02, 464.03, 550, 464.2

[56] References Cited

U.S. PATENT DOCUMENTS 4,780,835 10/1988 Sievel et al. ..... 364/550

4,812,965 3/1989 Taylor ..... 364/550

5,075,852 12/1991 Salazar et al. ..... 364/464.02

FOREIGN PATENT DOCUMENTS 0376573 7/1990 European Pat. Off. .

*Primary Examiner*—Edward R. Cosimano

*Attorney, Agent, or Firm*—Shoemaker and Mattare, Ltd.

[57] ABSTRACT

A franking machine is provided with means to communicate with a postal authority station and with sensors response to mis-treatment or mal-function of the franking machine. The machine is operated periodically to establish communication with the postal authority station periodically and if any sensors have been set by mis-treatment or mal-function, a signal indicating mis-treatment or mal-function is transmitted by the franking machine to the postal authority station. The communication may be effected each time the machine is operated to frank a mail item or may be effected less frequently, for example in respect of a franking operation in which a plurality of mail items are franked or each time the machine is powered up.

10 Claims, 2 Drawing Sheets

FRANKING MACHINE AND FRANKING MACHINE SYSTEM

BACKGROUND OF THE INVENTION

This invention relates to franking machines and in particular to the detection of attempts to operate the franking machine fraudulently or to gain unauthorised access to the franking machine.

Franking machines are utilised to frank items of mail by printing on the mail item a franking impression indicating that a postage charge for the item has been accounted for. Commonly franking machines operate in a pre-payment mode in which a value of credit is stored in a resister of the franking machine and as a part of each operation to frank an item, the credit value is decremented by an amount equal to a postage charge for the item. Other resisters of the franking machines are usually provided to maintain for example a total value of postage charge dispensed by the franking machine, the number of items franked and the number of items franked with a postage charge greater than a predetermined value. In electronic franking machines using a microprocessor to carry out accounting and control functions, it is usual to implement each register in each of two separate non-volatile electronic memory devices and to duplicate each resister in each memory device. Thus there are four copies of each resister. The microprocessor, memory devices and other circuits utilised for carrying out accounting and control operations of the franking machine are housed in a secure housing in order to prevent unauthorised access to these circuits. During operation of the machine, each copy of each register is updated for each franking transaction and provided no faults occur each copy of a register contains identical accounting data. Prior to carrying out a franking operation, the microprocessor carries out a sub-routine in which a check is carried out to determine that the data recorded in each copy of the registers is valid. If the contents of one copy of a register differs from the contents of other copies of the register further operation of the franking machine is inhibited. It is then necessary for an authorised service engineer to obtain access to the circuits in the secure housing to diagnose and correct the fault. At the same time it is necessary to determine the values which should be registered in the registers and to set all copies of the registers to the correct values.

It will be appreciated that in printing a franking impression and carrying out accounting for the value of the postage charge with which the item is franked, the franking machine is dispensing value. The franking machine is accounting for revenue to the postal authority and is accounting for expenditure in respect of postage charges of the user of the franking machine. Accordingly it is essential that the franking machine carries out the accounting functions correctly and without error with respect to postage charges applied by the franking impressions to mail items. A concern of postal authorities is that the franking machine cannot be utilised in a fraudulent manner to frank mail items with postage charges which are not accounted for by the accounting circuit of the franking machine. That is to say, that for each printing of a franking impression there is a corresponding accounting for the postage charge printed in the impression.

Access to the interior of the secure housing is obtained only by breaking one or more seals applied by the postal authority, or authorised representatives thereof, to the secure housing. However despite secure measures being applied to prevent unauthorised access to the secure parts of the franking machine there is always a possibility that a determined person with fraudulent intent will manage to circumvent the security measures and then be able to use the franking machine fraudulently.

SUMMARY OF THE INVENTION

According to one aspect of the invention a franking machine includes a secure housing; electronic means for carrying out accounting and control functions disposed in said secure housing; at least one sensor responsive to a fault condition of the franking machine; transmission means operable to transmit a signal to a remote location; and said electronic means being operative in response to said sensor sensing a fault condition to operate said transmission means to transmit said signal.

According to a second aspect of the invention a franking machine includes a secure housing; electronic means for carrying out accounting and control functions disposed in said secure housing; at least one sensor responsive to a fault condition of the franking machine; transmission means operable to transmit a signal to a remote location; and said electronic means being operative to establish that communication by said transmission means with a remote station is effective in respect of each franking operation to be performed by the franking machine and in response to said sensor sensing a fault condition to operate said transmission means to transmit said signal.

According to another aspect of the invention a franking machine system includes at least one franking machine as defined hereinbefore and a remote centre for reception of signals transmitted by the transmitter of the franking machine.

BRIEF DESCRIPTION OF THE DRAWING

An embodiment of the invention will be described hereinafter with reference by way of example to the drawings in which.

DESCRIPTION OF THE PREFERRED EMBODIMENT

Figure 1:
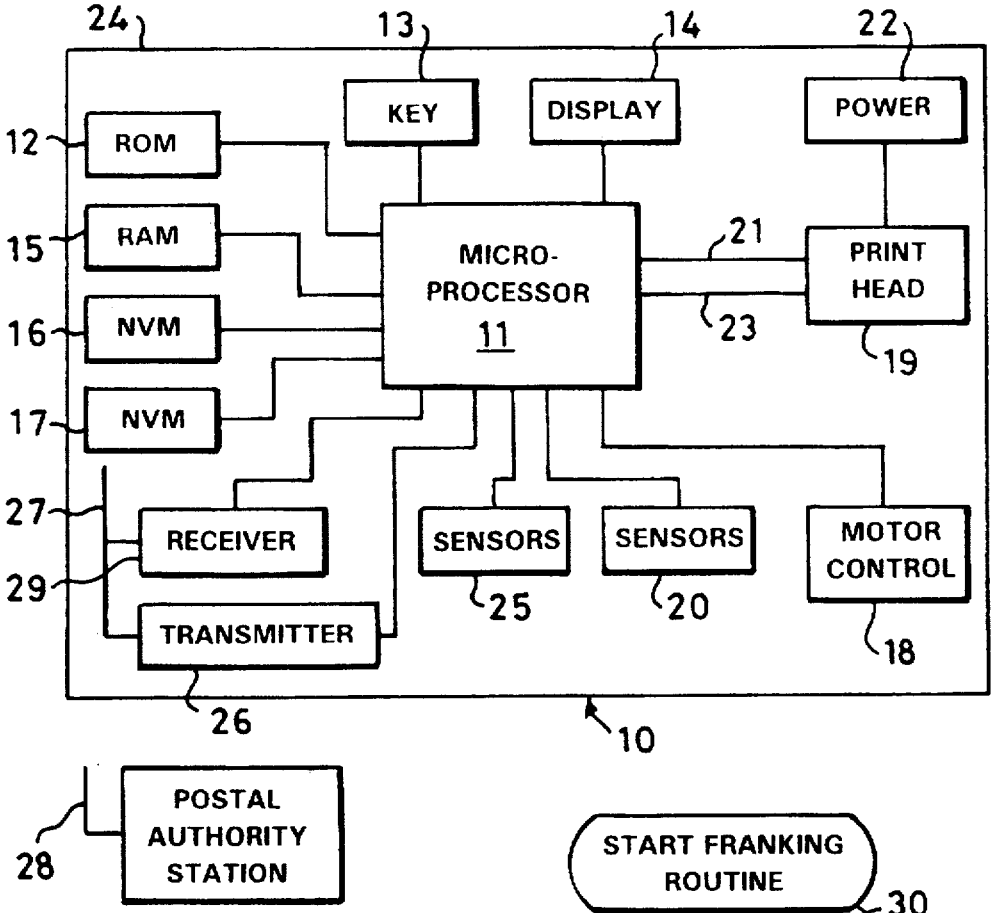
FIG. 1 is a block diagram of elements of a franking machine system in accordance with the invention.

Referring first to FIG. 1, operation of the franking machine 10 is effected by means of a micro-processor 11 operating under program routines stored in a read only memory (ROM) 12. As is well known in electronic franking machines, a keyboard 13 is provided for input of data by a user and a display 14 is provided to enable display of information to the user. A random access memory (RAM) 15 is provided for use as a working store for storage of temporary data during operation of the franking machine. Non-volatile duplicated memories 16, 17 are provided for the storage of data which is required to be retained even when the franking machine is not powered. Accounting data relating to use of the franking machine for printing franking representing postage charges for mail items and any other critical data to be retained is stored in the non-volatile memories 16, 17. A motor controller 18 is controlled by the microprocessor to control operation of motors for driving means (not shown) for feeding mail items past a thermal print head 19 and for winding a thermal transfer ink ribbon onto a take-up spool. Sensors 20 are provided to sense and monitor feeding of the mail item and of the ink ribbon. The sensors provide signals to the microprocessor to enable the microprocessor to control operation of the machine. For example a sensor is provided to indicate the speed of feeding of the mail item along the feed bed to enable the microprocessor to control speed of drive of a motor driving the impression roller such that the feed speed is maintained substantially constant. As the mail item is fed past the thermal printing elements of the print head, the microprocessor outputs, on line 21, to the print head in each of a plurality of printing cycles signals selecting those ones of the printing elements which are to be energised in the respective cycle. A pulse of electrical power is supplied to the selected thermal printing elements from a power source 22 when a strobe signal, on line 23, is supplied by the microprocessor. As is well known those parts of the franking machine concerned with carrying out accounting and control functions in relation to franking of mail items are housed in a secure housing 24 to prevent unauthorised access to those parts. The general construction and operation of franking machines is well known and accordingly it is believed to be unnecessary to describe the franking machine in further detail. It will be appreciated that although the franking machine is described hereinbefore as having a thermal print head, other means of printing a franking impression may be provided and for example the franking impression may be printed by means of print elements carried on a rotatable print drum.

In accordance with the invention, the franking machine is provided with sensors 25 to detect attempts to misuse the franking machine and in particular attempts to operate the franking machine fraudulently and attempts to gain access to the interior of the secure housing 24. The sensors 25 may be arranged to detect unauthorised physical or mechanical treatment of the machine which could result in fraudulent operation of the machine. For example, one or more sensors 25 may be provided to detect breaking of seals securing the housing or detect opening of any part of the housing to gain access to the interior of the secure housing. Other sensors 25 may be provided to detect unauthorised electrical treatment of the franking machine, for example, the application of electrical signals or voltages to the electronic circuits such as could result in incorrect accounting for postage value used in franking mail items.

A radio transmitter 26 is located within the secure housing 24 and is operable by the microprocessor to transmit, via an aerial 27, a radio signal which can be received by a postal authority station 28. The radio transmitter 26 is housed within the secure housing 24 and the aerial 27 preferably is incorporated in the structure of the franking machine 10. When any one of the sensors 25 detects an unauthorised treatment or attempt at unauthorised treatment of the franking machine, the microprocessor enables the radio transmitter 26 to transmit a signal. The signal when received by the postal authority station 28, alerts the postal authority that the unauthorised treatment or attempt at unauthorised treatment of the franking machine 10 has been detected. The transmission by the radio transmitter 26 comprises a message unique to the specific franking machine 10. The message may be unique by transmitting data unique to the franking machine or by other means such as frequency of signal to enable identification of the franking machine. Preferably the message contains data enabling the postal authority to determine the type of fault detected. Upon being alerted by receipt of the radio transmission message, the postal authority is enabled to take any action desired in order to terminate the use of the franking machine.

Figure 2:
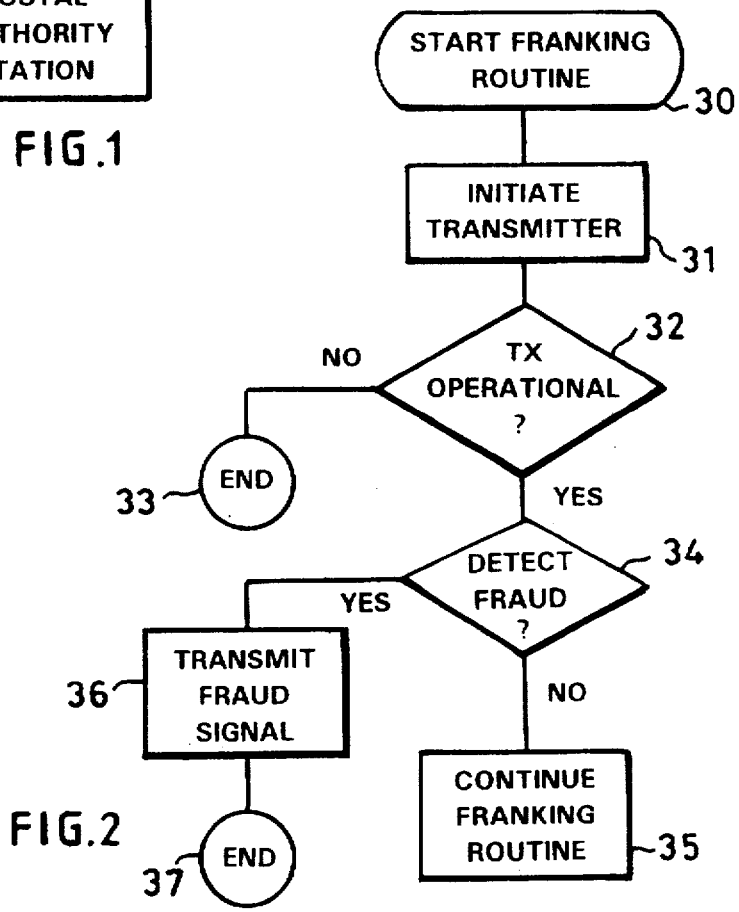
FIG. 2 is a flow chart of steps in the operation of the franking machine.
Figure 3:
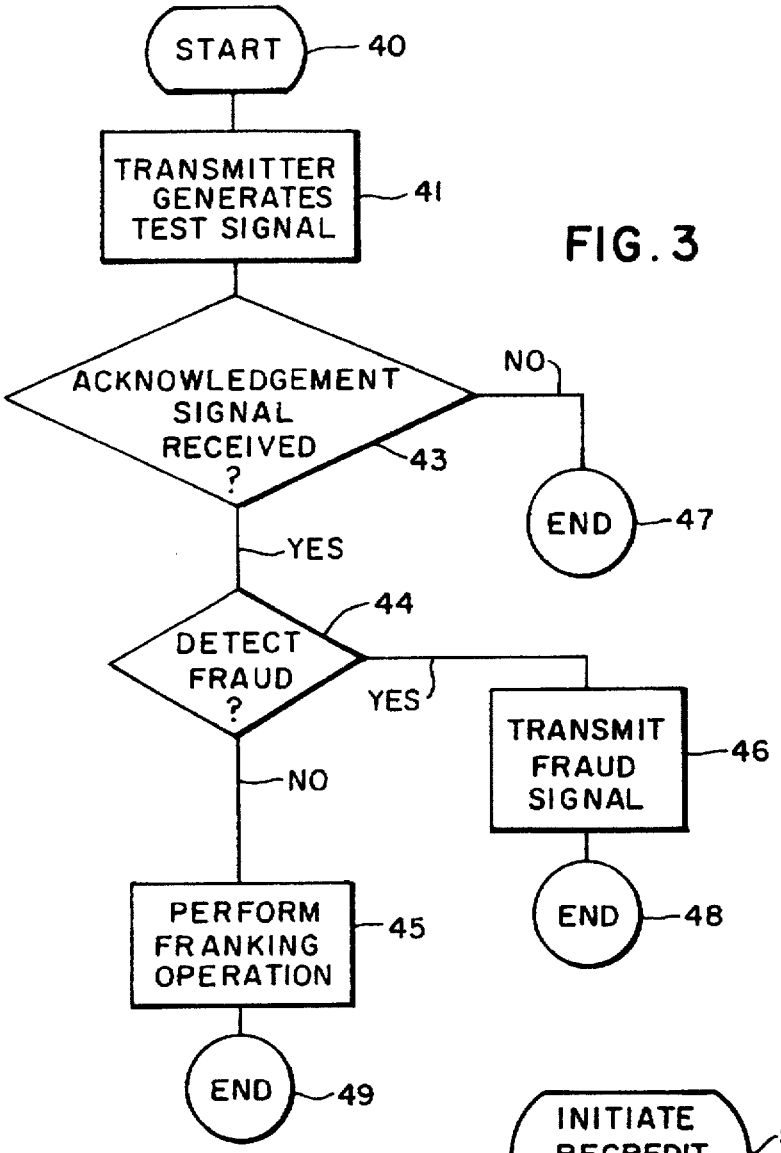
FIG. 3 is a flow chart of an alternative sequence of steps in the operation of the franking machine and FIG. 4 is a flow chart illustrating use of a transmitter and receiver in a re-credit routine.
Figure 4:
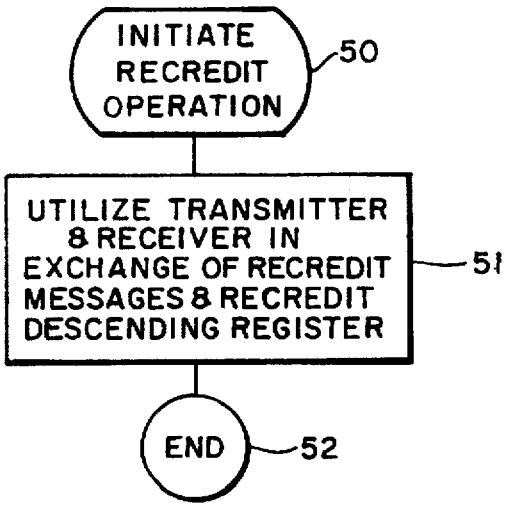

It is desirable that the microprocessor 11 checks operation of the radio transmitter 26 during a power up routine or as part of a franking routine. FIG. 2 is a flow chart of steps carried out when the operation of the transmitter 26 is checked as a part of a franking routine. After starting a franking routine (box 30), operation of the transmitter 26 is initiated (box 31) and a check (decision box 32) is carried out to determine if the transmitter is operative. If the transmitter is not operative (NO output of decision box 32) the franking routine is terminated (END 33) by the microprocessor 10. If the transmitter is determined to be operational (YES output of decision box 32) the status of the sensors 25 is checked (decision box 34). If none of the sensors 25 have detected unauthorized operation of the franking machine (NO output of decision box 34) the franking routine is continued (box 35). However if any one of the sensors 25 has detected an unauthorised operation of the franking machine (YES output of decision box 34) the transmitter is operated to transmit a fraud RF signal (box 36) indicating that unauthorised operation of the franking machine 10 has occurred and the franking routine is terminated (box 37). Determination that the transmitter is operative may be effected locally by a receiver 29 sensing that RF signals generated by the transmitter 26 are being radiated from the aerial 27. However increased security may be achieved by a two way communication with the postal authority station 28 to determine if the transmitter 26 is operative as illustrated by the flow chart of FIG. 3. During checking of the operation of the transmitter 26, after start (box 40) of a routine the transmitter generates (box 41) a test RF signal which is radiated by the aerial 27 and received by the postal authority station. In response to reception of the test RF signal by the postal authority station, the postal authority station transmits an acknowledgement signal to be received by the receiver 29 of the franking machine 10. A signal is output by the receiver 29 to the microprocessor only if (YES output of decision box 43) the transmitter 26 has been operated. Checking that the transmitter is operational may be carried out at power-up only of the machine but, if desired, additional checks that the transmitter is operative may be carried out periodically while the franking machine is operational. The microprocessor may be operative to determine that there is effective communication for a franking operation comprising a single franking routine in which a single mail item is franked or may be operative to determine that there is effective communication for a franking operation comprising a plurality of franking routines in which more than one mail item is franked. If the transmitter is determined to be operational (YES output of decision box 43) the status of the sensors 25 is checked (decision box 44). If none of the sensors 25 have detected unauthorised operation of the franking machine (NO output of decision box 44) the franking routine is performed (box 45). However if any one of the sensors 25 has detected an unauthorised operation of the franking machine (YES output of decision box 44) the transmitter is operated to transmit a fraud RF signal (box 46) indicating that unauthorised operation of the franking machine 10 has occurred and the franking routine is terminated (box 48). If the acknowledgement signal is not received (NO output of decision box 43) the routine ends (box 47). After transmission of a fraud signal (box 46) the routine ends (box 48). After performing a franking operation (box 45) the routine ends (box 49).

While the provision of sensors and the radio transmitter to transmit a signal in response to fraudulent invasion or fraudulent operation of the franking machine, the transmitter 26 may be operated by the microprocessor in response to non-fraudulent faults such as may occur as a result of natural malfunction of elements of the franking machine. Accordingly the postal authority can be alerted to occurrence of a fault and can determine if the fault is a critical fault of such a nature as requires immediate attention or is a fault which does not require immediate attention but needs attention in the future.

In addition to utilising the transmitter 26 to provide an indication to a postal authority of the existence of a fault condition, the transmitter 26 and receiver 29 may be utilised to permit recrediting of the descending resister in the NVM memories 16, 17 of the franking machine. A recrediting operation is initiated (box 50) and requires an exchange of messages box 51) between the franking machine 10 and a postal authority resetting centre which may be located at or in communication with the postal authority station 28. These messages carry data such as an amount of credit with which the credit register of the machine is to be incremented and readings of the contents of resisters of the machine. Some or all of these messages may include security codes and be encrypted in order to maintain security of the recrediting operation. Remote recrediting of a franking machine by means of messages transmitted via a telephone network is described in our European patent specification 0 376 573. Upon completion of the recrediting operation, the operation terminates (box 52).

While the embodiment described hereinbefore utilises radio frequency transmission for communication between a franking machine and a postal authority station, it is to be understood that other forms of communication may be utilised and for example the communication may be effected by light radiation such as infra-red or via a telephone network. If desired a combination of communication methods may be utilised.

I claim:

1. A franking machine including a secure housing; electronic means for carrying out accounting and control functions disposed in said secure housing; at least one sensor responsive to a fault condition of the franking machine; transmission means operable to transmit a signal to a remote location; and said electronic means being operative to establish that communication by said transmission means with a remote station is effective in respect of each franking operation to be performed by the franking machine and in response to said sensor sensing a fault condition to operate said transmission means to transmit said signal.

2. A franking machine as claimed in claim 1 wherein the transmission means is operable to transmit a radio frequency signal.

3. A franking machine as claimed in claim 1 wherein the sensor is responsive to unauthorised attempts to gain access to the secure housing.

4. A franking machine as claimed in claim 1 wherein the sensor is responsive to misuse of the franking machine.

5. A franking machine including a secure housing; electronic means for carrying out accounting and control functions disposed in said secure housing; at least one sensor responsive to a fault condition of the franking machine; transmission means operable to transmit a signal to a remote location; and said electronic means being operative in response to said sensor sensing a fault condition to operate said transmission means to transmit said signal wherein said electronic means is operable to carry out a franking operation to frank a mail item with a postage charge and wherein, prior to carrying out said franking operation, said electronic means determines if said transmission means is operable and continues with the franking operation only if said transmission means is operable.

6. A franking machine as claimed in claim 5 including a receiver operative to receive signals transmitted by the transmission means.

7. A franking machine as claimed in claim 5 wherein the sensor is responsive to unauthorised attempts to gain access to the secure housing.

8. A franking machine as claimed in claim 5 wherein the sensor is responsive to misuse of the franking machine.

9. A franking machine as claimed in claim 5 including a receiver operative to receive signals transmitted by a postal authority in response to receipt by the postal authority of signals transmitted by the transmission means.

10. A franking machine as claimed in claim 9 wherein the transmission means and receiver are operable to transmit and receive respectively messages for performing an operation to increment a credit register of the franking machine.

* * * * *